US006883799B2

(12) United States Patent
Matsuki et al.

(10) Patent No.: US 6,883,799 B2
(45) Date of Patent: Apr. 26, 2005

(54) SHEET FEEDING APPARATUS AND IMAGE FORMING APPARATUS

(75) Inventors: Satoru Matsuki, Yamanashi-ken (JP); Tomohisa Shimizu, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 343 days.

(21) Appl. No.: 10/273,136

(22) Filed: Oct. 18, 2002

(65) Prior Publication Data

US 2003/0075857 A1 Apr. 24, 2003

(30) Foreign Application Priority Data

Oct. 19, 2001 (JP) ..... 2001-321985
Oct. 19, 2001 (JP) ..... 2001-322011

(51) Int. Cl.[7] ..... B65H 31/20; B65H 1/00; B65H 1/22; B65H 1/26

(52) U.S. Cl. ..... 271/171; 271/145; 271/223; 399/376

(58) Field of Search ..... 271/171, 145, 271/223; 399/376

(56) References Cited

U.S. PATENT DOCUMENTS 6,134,027 A * 10/2000 Lee ..... 358/474
6,151,478 A * 11/2000 Katsuta et al. ..... 399/372
2002/0044809 A1 * 4/2002 Hayashi et al. ..... 399/391

* cited by examiner

*Primary Examiner*—Donald D. Walsh
*Assistant Examiner*—Kenneth W Bower
(74) *Attorney, Agent, or Firm*—Manabu Kanesaka

(57) ABSTRACT

A sheet feeding apparatus includes a sheet storage portion that can store sheets with various sizes and accurately detect a size of the sheets. The sheet feeding apparatus has a sheet storage device, a supporting device for supporting the sheet storage device in a moving path between a sheet replenishing position and a sheet feeding position, a frame for fastening the supporting device, a sheet feeding device for separating the sheets into a single sheet and feeding the single sheet, and a sheet size detecting device established in the moving path for detecting the size of the sheets stored in the sheet storage device. The sheet size detecting device overlaps the sheet storage device in a sheet stacking direction when the sheet storage device is positioned at the sheet feeding position.

16 Claims, 12 Drawing Sheets

SHEET FEEDING APPARATUS AND IMAGE FORMING APPARATUS

BACKGROUND OF THE INVENTION AND RELATED ART STATEMENT

This invention relates to a sheet feeding apparatus that separates and feeds single sheets into an image forming apparatus such as a copier or printing apparatus.

Many image forming apparatus such as copiers or printers comprise a sheet storage portion for storing sheets to form images such as characters or drawings thereupon and are provided a sheet feeding apparatus for drawing out one sheet at a time as required and for feeding them to the image forming portion.

The sheet storage portions in these sheet feeding apparatuses are formed to allow the storage of a variety of sheet sizes. The image forming apparatuses is made to input the size data of the sheets stored in the aforementioned sheet storage portion from the sheet feeding apparatus to perform a variety of controls such as checking the conformity of the original size and the sheet size and for setting the jam timer for detecting sheet jams in the sheet feed path.

The image forming apparatus has limits in being as compact as possible because it handles one or a plurality of sheets the sizes of which is prescribed by all types of standards, but there is always a great need to reduce the space required for image forming apparatus in offices, so it is necessary to reduce the size of image forming apparatus, particularly their footprint as much as is possible.

However, in conventional sheet feeding apparatuses, various types of sheet size detecting means are used to detect the size of sheets stored in the sheet storage portion.

In an example of the most common type of sheet size detecting means in the current technology, the sheet detecting means that is a mechanical detecting means such as an optical detecting means or limit switches are established the bottom surface of the sheet storage portion or in plurality below the image forming apparatus to detect the size of the sheets stored in the sheet storage portion (the first prior art example).

Another example is when a sheet feeding apparatus comprising a sheet storage portion is installed in a prescribed sheet feeding position inside the image forming apparatus, a sheet detection means mounted on the image forming apparatus frame side for storing the sheet feeding apparatus detects the size of the sheets stored in the sheet storage portion (the second prior art example).

However, in the aforementioned first prior art example, depending on the set docking position of the image forming apparatus and the sheet feeding apparatus, the relative position of the sheet size detection means with regard to the sheet differs causing the problem of not being able to accurately detect the size of the sheets.

Also, in the aforementioned second prior art example, because the sheet detecting means is mounted to the frame of the image forming apparatus that stores the sheet feeding apparatus, the size of the footprint of the image forming apparatus necessarily must be enlarged that much.

An object of the present invention is to provide sheet feeding apparatus comprising a sheet storage portion that can store a variety of sheet sizes and that can accurately detect the size of the sheets that are stored therein and that has a more compact apparatus size.

SUMMARY OF THE INVENTION

In order to attain that object, the invention provides a sheet feeding apparatus composed of a sheet storage means, a supporting means for movingly supporting the aforementioned sheet storage means in a moving path between a sheet replenishing position and a sheet feeding position, a frame means for fixing the aforementioned supporting means, a sheet feeding means for separating sheets into single sheets from inside a sheet storage means positioned in the aforementioned sheet feeding position and for drawing them out, and a sheet size detecting means for detecting the size of the sheets stored in the aforementioned sheet storage means, the aforementioned sheet size detecting means being established at the position entering the aforementioned moving path in the aforementioned frame.

Here, the aforementioned sheet size detecting means is arranged in a position overlapping the aforementioned sheet storage means looking from the sheet stacking direction, when the aforementioned sheet storage means is positioned at the aforementioned sheet feeding position.

In the sheet feeding apparatus relating to this invention, this enables a compact apparatus because the sheet size detecting means does not protrude outward of the sheet feeding apparatus.

Furthermore, according to this invention, the aforementioned sheet size detecting means is composed of one or a plurality of size detecting levers that actuate by the lever pushing portion in a sheet regulating means making contact, and is configured to detect the size of the sheets stored in said sheet storage means according to which detection lever of said one or said plurality of detecting levers actuates.

This invention makes it possible for the sheet detection means to accurately and in a stable manner detect the sizes of sheets stored without being affected by the status of the joining of the sheet feeding apparatus and the image forming apparatus and without it being necessary to precisely position the image forming apparatus and the sheet feeding apparatus.

In order to attain that object, the invention is further composed of a sheet storage means comprising an elevating sheet support stand, a drive means for causing driving force to elevate the aforementioned sheet support stand, a drive transmission means to transmit the aforementioned driving force to the aforementioned sheets storage means, a supporting means for movingly supporting the aforementioned sheet storage means in a moving path between a sheet replenishing position and a sheet feeding position, a frame means for fixing the aforementioned supporting means, a sheet feeding means for separating sheets into single sheets from inside a sheet storage means positioned in the aforementioned sheet feeding position and for drawing them out, and a sheet size detecting means for detecting the size of the sheets stored in the aforementioned sheet storage means, the aforementioned sheet size detecting means being arranged overlapping the aforementioned drive transmission means looking from the sheet stacking direction.

In the sheet feeding apparatus relating to this invention, this enables an even further compact apparatus because the drive transmission means does not protrude outward of the sheet feeding apparatus.

The aforementioned drive transmission means is composed of a first drive transmission means established on the aforementioned frame means and a second drive transmission means established on the aforementioned sheet storage means and separable from the aforementioned first drive transmission means. Also, the aforementioned first drive transmission means and the second drive transmission means are joined when the aforementioned sheet storage means is at the aforementioned feeding position, and are separated when the aforementioned sheet storage means is at the sheet replenishing position.

Furthermore, the sheet feeding apparatus according to the present invention is composed of a sheet storage means, a supporting means for movingly supporting the aforementioned sheet storage means in a moving path between a sheet replenishing position and a sheet feeding position, a frame means for fastening the aforementioned supporting means, a sheet feeding means for separating sheets into single sheets from inside a sheet storage means positioned in the aforementioned sheet feeding position and for drawing them out, and a sheet size detecting means for detecting the size of the sheets stored in the aforementioned sheet storage means, the aforementioned sheet size detecting means being established at the position overlapping the aforementioned moving path looking from the sheet stacking direction.

Furthermore, this invention is an image forming apparatus equipped with a sheet storage means and is composed of an elevating sheet support stand, a drive means for causing driving force to elevate the aforementioned sheet support stand, a drive transmission means to transmit the aforementioned driving force to the aforementioned sheets storage means, a supporting means for movingly supporting the aforementioned sheet storage means in a moving path between a sheet replenishing position and a sheet feeding position, a frame means for fixing the aforementioned supporting means, a sheet feeding means for separating sheets into single sheets from inside a sheet storage means positioned in the aforementioned sheet feeding position and for drawing them out, and a sheet size detecting means for detecting the size of the sheets stored in the aforementioned sheet storage means, arranged overlapping the aforementioned drive transmission means looking from the sheet stacking direction.

BRIEF DESCRIPTION OF THE DRAWINGS

FIGS. 3A, 3B show an example of the sheet storage means in the sheet feeding apparatus, wherein FIG. 3A shows the uppermost sheet stored in the sheet storage means touching the pick-up roller of the sheet feeding means, and FIG. 3B is the sheet storage means without sheets stored therein, the sheet supporting stand (bottom surface plate) lowered to its lowest position;

DETAILED DESCRIPTION OF PREFERRED EMBODIMENTS

The following describes in detail the first embodiment of the sheet feeding apparatus 1 according to the present invention based on the drawings provided.

Figure 1A:
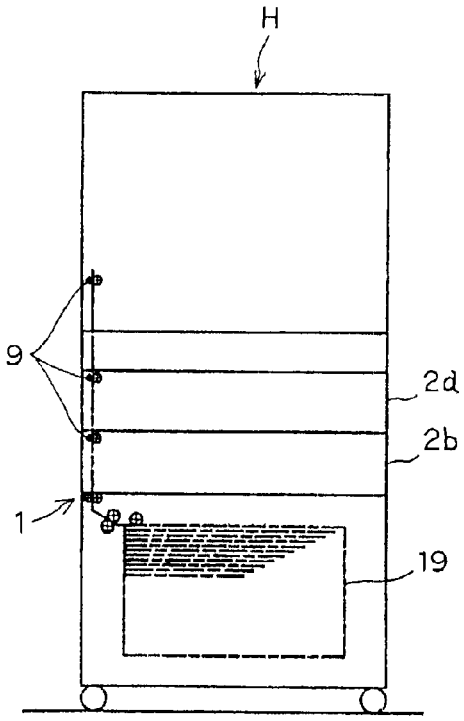
FIGS. 1A, 1B are views showing an example of the sheet feeding apparatus in the sheet feeding position, connect to an image forming apparatus such as a copier.
Figure 1B:
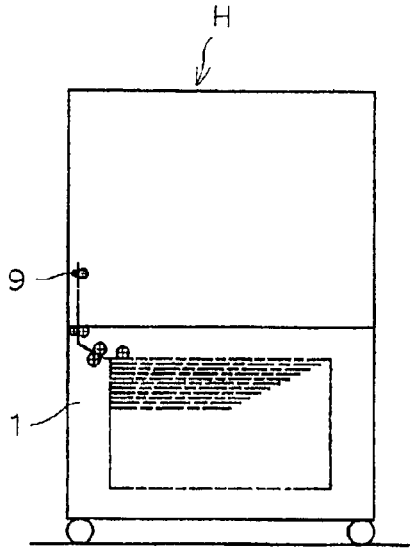
Figure 2:
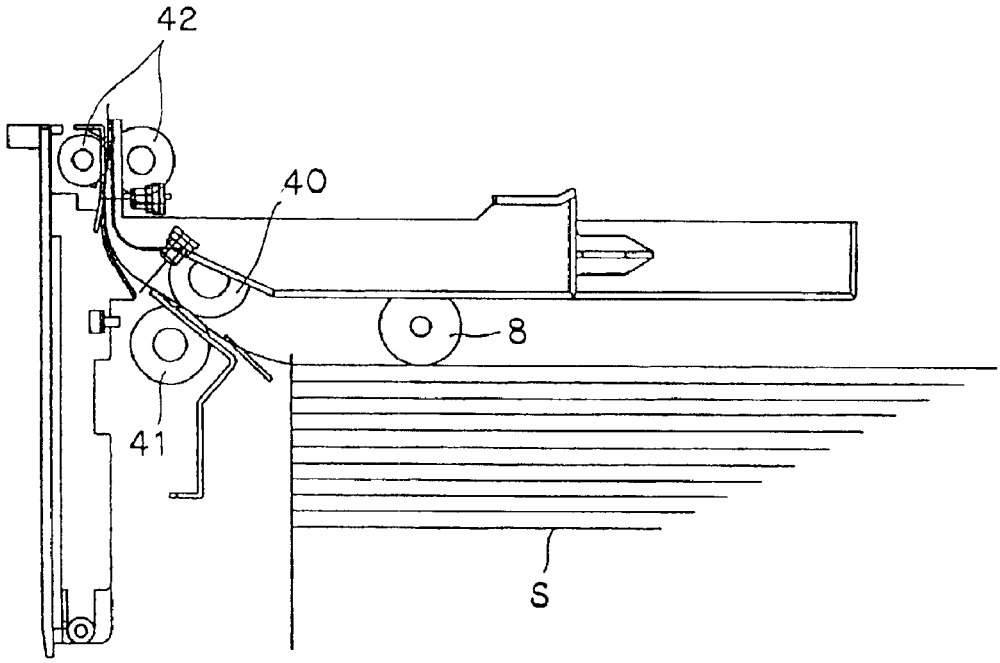
FIG. 2 is a drawing showing a sheet stored in the sheet storage means being transported to the image forming apparatus by the pick-up rollers.

FIGS. 1A, 1B are views showing examples of the sheet feeding apparatus 1 in the sheet feeding position, connecting to an image forming apparatus H such as a copier. FIG. 2 is a drawing showing a sheet stored in the sheet feeding apparatus 1 being fed one at a time to the image forming apparatus H by the sheet feeding means such as the pick-up rollers 8.

The image forming apparatus H is formed by a printer composed of a laser scanner that scans laser light according to the image information on the upper apparatus unit H, the image processing unit, the transfer rollers, the fixer (not shown in the drawings) and the transport rollers 9. Also, the sheet feeding apparatus 1 is formed on the lower side of the image forming apparatus H.

The sheet S stored in the sheet feeding apparatus 1 and 2 is transported with a determined timing to the aforementioned printer by a transport means including the pick-up rollers 8, shown in FIG. 2.

FIG. 1A shows a configuration of a plurality of sheet feeding apparatus 1, 2*a* and 2*b* established on the image forming apparatus H. Each of the sheet feeding apparatus 1, 2*a,* and 2*b* are configured to each have independent functions. The sheet feeding apparatus 1 is a feeding apparatus comprising a sheet size detecting means that can stack a variety of sheet sizes. It is acceptable for the sheet feeding apparatuses 2*a* and 2*b* to be used by allocating fixed sizes of the sheet S to the sheet feeding apparatus 2 and 2*b*.

Also, FIG. 1B shows the image forming apparatus H equipped with only one sheet feeding apparatus comprising a sheet size detecting means that can stack a variety of sheet sizes. Because feeding is done with the sheet feeding apparatus 1 that can stack a plurality of sizes of sheets, the image forming apparatus H can be made more compact compared to the apparatus shown in FIG. 1A.

The following describes the configuration and operation of the sheet feeding apparatus 1 according to the first embodiment of the present invention.

The sheet feeding apparatus 1 comprises the sheet storage means (sheet storage cassette) 19, the sheet support stand 7 established in the sheet storage means 19, the supporting means 30 for movingly supporting the sheet storage means 19 in the moving path 24 between the sheet replenishment printing position and the sheet feeding position and the frame 10 that fastens the supporting means 30.

The sheet feeding apparatus 1 frame 10 is a box-type frame structure. The frame 10 supports the entire outer frame of the rail allowing the sheet storage means 19 to move through the moving path 24 between the sheet replenishment position and the sheet feeding position. Also, to the inside of the frame 10 is established the moving path 24 for opening and closing the sheet storage means 19.

Still further, the sheet feeding means in the sheet feeding apparatus 1 is composed of the pick-up rollers 8 that separate and draw out sheets from the sheet storage means 19 at the sheet feeding position, the feed rollers 40, separation rollers 41, the paired resist rollers 42 and the transport rollers 9.

Still further, the sheet feeding apparatus 1 is composed of the pressure regulating roller 3 which is the sheet regulating means for regulating one edge of the sheet S at a position corresponding to the size of the sheet S stored in the sheet storage means 19, the pressure regulating plate 4, the trailing edge support guide 5 and the sheet size detecting means 20 for detecting the size of the sheet S stored in the sheet storage means 19 by acting together with the sheet regulating means established in the frame 10.

Figure 3A:
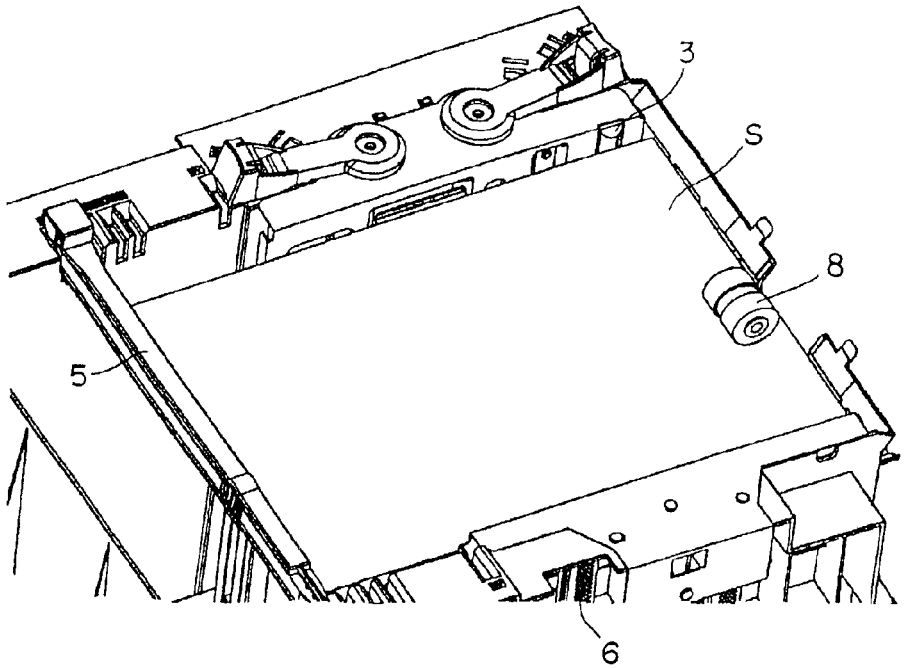
Figure 3B:
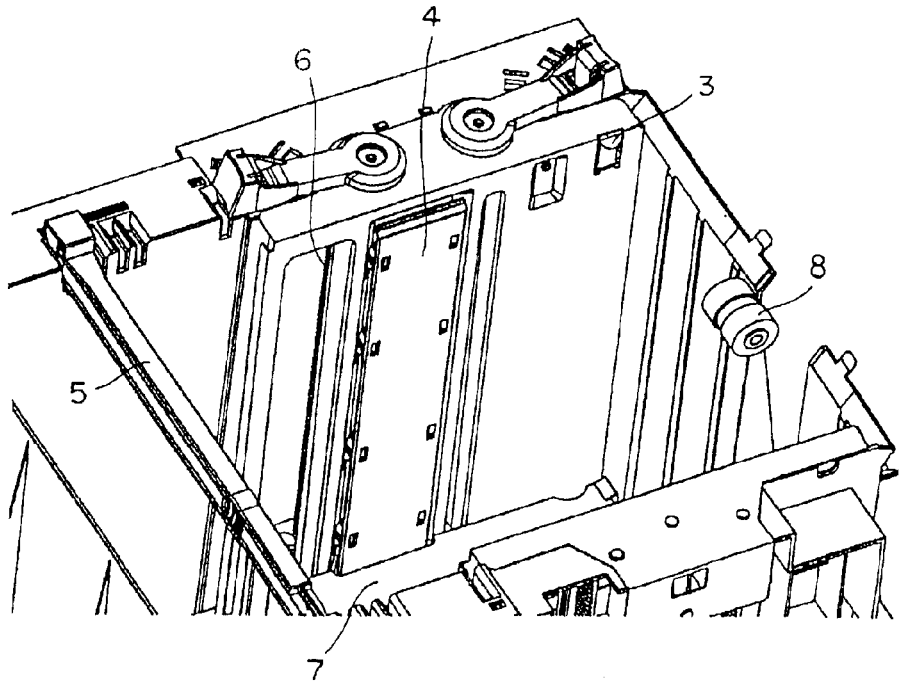

FIGS. 3A, 3B are views showing an example of the sheet storage means 19 in the sheet feeding apparatus 1. FIG. 3A shows the uppermost sheet stored in the sheet storage means touching the sheet feeding means pick-up roller 8. FIG. 3B shows the sheet storage means without sheets stored therein and the sheet support stand 7 (the bottom surface plate) at its lowest position.

The sheet feeding apparatus 1 is composed of the frame 10, the sheet storage means 19 and the sheet feeding means arranged in the frame 10. The sheet storage means 19 is configured to be pulled from the frame 10 by the handle 17 formed on the front cover of the sheet storage means 19 to allow the replenishment of sheets.

As shown in FIGS. 3A, 3B, the sheet storage means 19 comprises the sheet support stand 7 for storing sheets, the trailing edge support guide 5 to regulate the trailing edges of the sheets, the pressure regulating roller 3 as the first regulating means for regulating one edge from downstream of the direction of sheet feeding and the pressure regulating plate 4 as the second regulating means for regulating one edge of the sheet. The sheet S stored on the sheet support stand 7 are aligned at the three regulating positions of the pressure regulating roller 3, the pressure regulating plate 4 and the trailing edge support guide 5.

Furthermore, the sheet support stand 7 (the bottom surface plate) rises to the position to touch the sheets to the pick-up roller 8 on the sheet feeding means when feeding the sheets (the state shown in FIG. 3A) and lowers to its lowest position when replenishing sheets (the state shown in FIG. 3B). Forward or reverse drive of the lift-up motor 11 is transmitted to the drive belt via the coupling 12 connected to the lift-up motor 11, and the drive belt connected to the sheet support stand 7 raises and lowers it.

Figure 4:
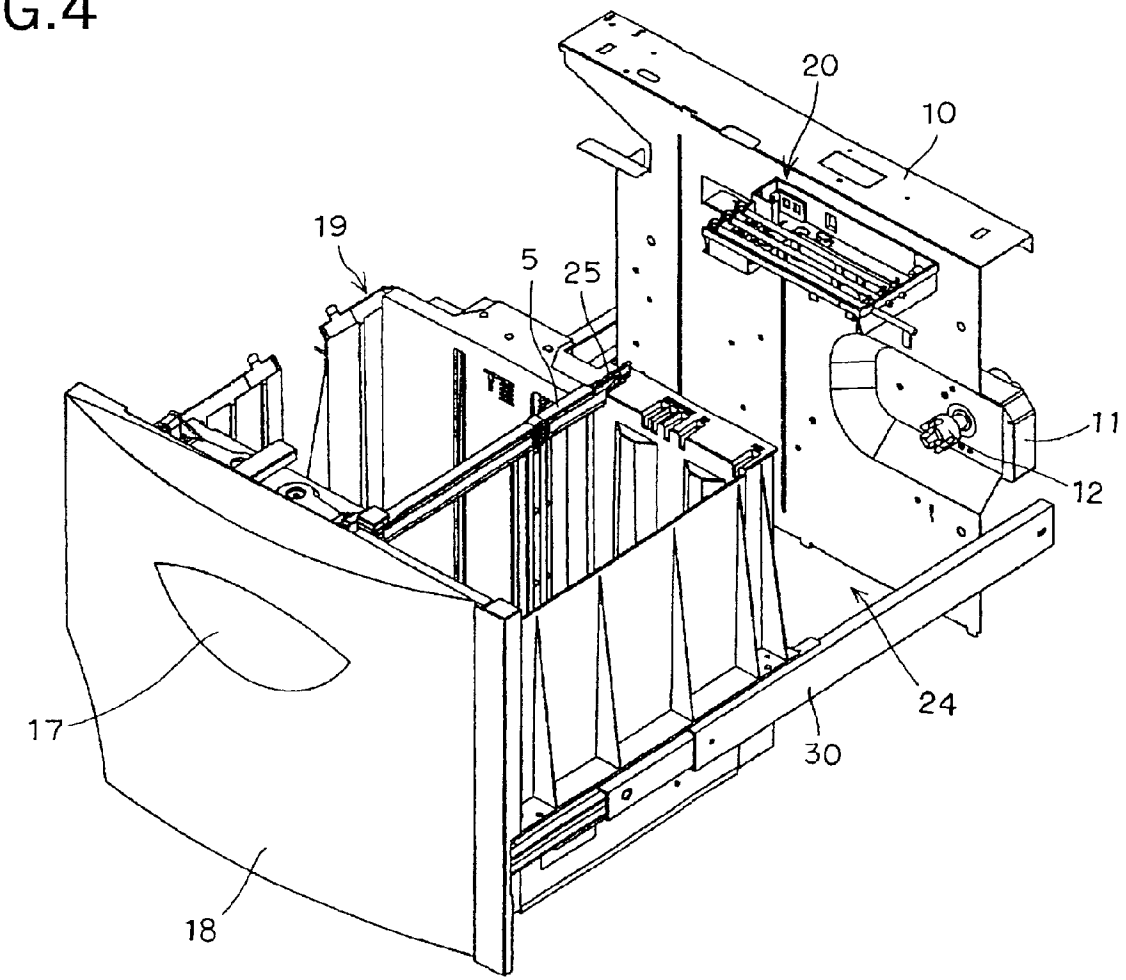
FIG. 4 is a perspective showing an example of the sheet feeding apparatus according to the present invention, and the sheet storage means pulled partway out from the sheet feeding apparatus to the sheet replenishing position.

FIG. 4 is a perspective showing an example of the sheet feeding apparatus according to the present invention, and the sheet storage means 19 pulled partway out from the frame 10 to the sheet replenishing position.

It is possible to move the sheet storage means 19 (cassette) to the sheet replenishing position by gripping the handle disposed on the front cover 18 of the sheet storage means 19 stored in the frame 10 and pulling it toward yourself. In that movement, the support rail which is the support means 30 that supports the sheet storage means 19 is configured to be extendable. The support means 30 is fastened to the frame.

The sheet storage means 19 is pulled out to the sheet replenishing position while being guided on the support rails of the support means 30. Also, sheets are stored in the sheet storage means 19 when it is pulled out from the frame 10. At that time, the sheet detecting means 20 disposed on the frame and the lift-up drive means coupling 12 separate from the sheet storage means 19.

Figure 5:
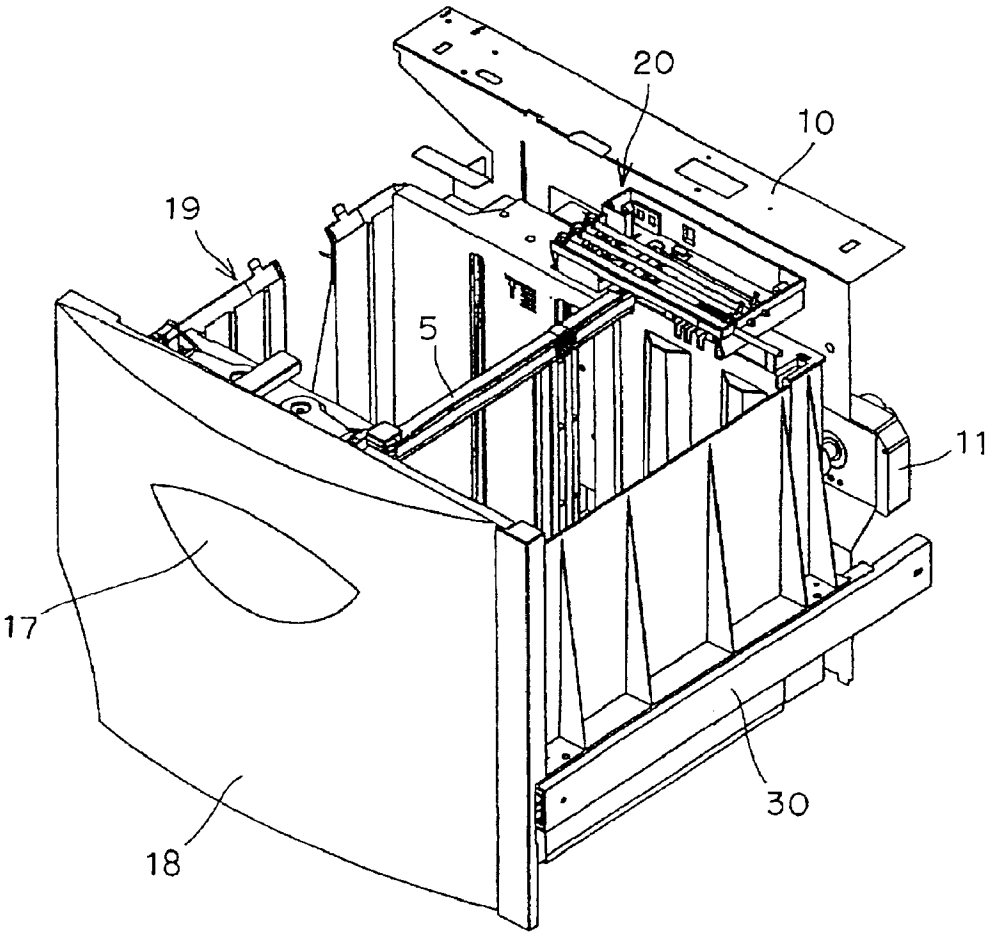
FIG. 5 is a perspective view showing the sheet storage means positioned at the sheet replenishing position inside the sheet feeding apparatus frame, the sheet size in the sheet storage means being detected.

FIG. 5 is a perspective view showing the sheet storage means 19 positioned at the sheet feeding position in the sheet feeding apparatus 1, the sheet size in the sheet storage means 19 being detected.

The movement of the sheet storage means 19 pushes the front cover 18 on the sheet storage means 19 which is at the sheet replenishing position described above, into the frame 10. When the front cover 18 is pushed into the frame 10, the support rail of the support means 30 that is supporting the sheet storage means 19 retracts to move the sheet storage means 19 to the sheet feeding position.

The sheet size detecting means 20 is established at the position where it enters the moving path 24 in the frame 10. Therefore, when the sheet storage means 19 is pushed in, and positioned at the sheet feeding position, the sheet size detecting means 20 is arranged at a position overlapping the sheet storage means 19 and the moving path 24, looking from the sheet stacking direction.

At that time, the lever pushing portion 25 disposed on one edge of the sheet trailing edge regulating guide 5 is configured to touch one or a plurality of detecting lever touching portions 23 formed on one or a plurality of size detection levers 22 on the sheet size detecting means 20.

When the sheet storage means is pushed into the main apparatus, the detection lever touching portion 23 touched by the lever touching portion 25 disposed on one edge of the sheet trailing edge regulating guide 5 rotates the size detection lever 22 with that pressing force. The sheet size detecting means 20 detects the size of the sheet by the size detecting sensor 21 detecting the rotation of one or a plurality of the size detection lever 22 that was touched. Furthermore, the coupling 12 which is the drive transmission means to elevate the sheet support stand 7 mates with the coupling pin 14 which is the second drive means disposed on the sheet storage means 19.

In this way, the sheet size detecting means 20 is arranged in an position overlapping the sheet storage means 19 from above looking from the sheet stacking direction at the sheet feeding position of the sheet storage means 19 so the sheet feeding apparatus 1 itself becomes more compact in its outer dimensions.

Furthermore, the lever pushing portion 25 disposed on one edge of the sheet trailing edge regulating guide 5 detects the sheet size by directly touching the detection lever touching portion 23 which has a determined length and width. This configuration greatly expands the amount of leeway for adjustments with regard to the mis-positioning when the sheet storage means 19 is positioned at the sheet feeding position. Still further, it enables a more simplified apparatus, lower costs and achieves low failure rates.

Figure 6:
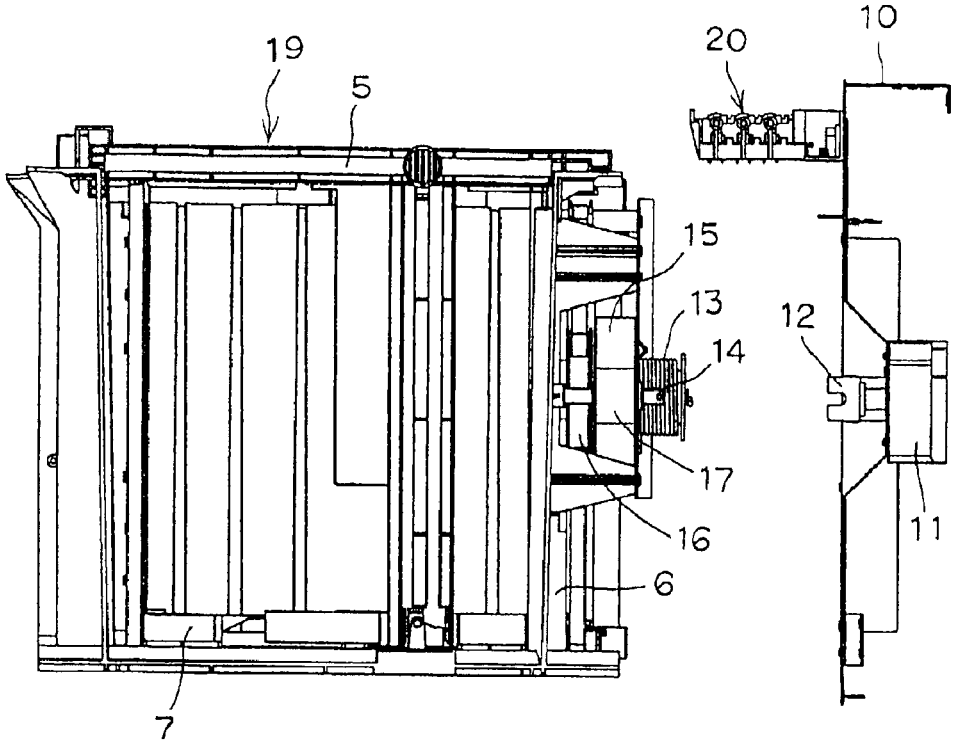
FIG. 6 is an elevated view showing an example of the sheet storage means shown in FIG. 4 pulled partway out from inside the sheet feeding apparatus to the sheet replenishing position.

FIG. 6 is an elevated view showing the sheet storage means 19 shown in FIG. 4 pulled partway out from inside the frame to the sheet replenishing position. Here, the first drive transmission means disposed on the frame means and the second drive means disposed on the sheet storage means separate.

The drive mechanism for elevating the sheet support stand 7 is composed of the lift-up motor 11 as the drive means disposed on the frame side, the drive mechanism comprising the coupling 12 as the first drive transmission means to transmit driving force from the lift-up motor 11, the coupling pin 14 formed to mate with the female portion formed on the coupling 12 on the sheet storage means 19 side, the auxiliary spring 13 for absorbing the shock when the sheet storage means 19 is pushed in and the drive rotation of the coupling 12, the small gear 17 which is the second drive transmission means, the large gear 15, the cam 16 and the drive belt 6.

The sheet support stand 7 connected to the belt 6 receives the forward and reverse rotating drive force transmitted via the gears through the belt to rise and lower. When positioned at the sheet replenishing position, the detection means 20 disposed on the frame and the sheet trailing edge regulating guide 5 touching portion 25 disposed on the sheet storage means are separated.

Figure 7:
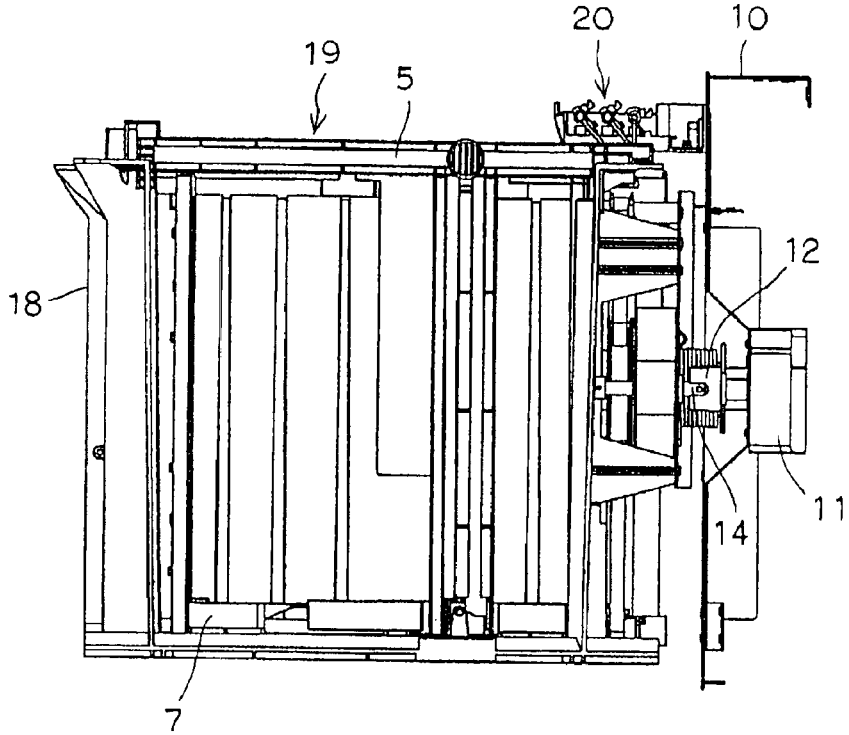
FIG. 7 is an elevated view showing an example of the sheet storage means shown in FIG. 5 positioned at the sheet feeding position inside the sheet feeding apparatus frame.

FIG. 7 is an elevated view showing the sheet storage means 19 shown in FIG. 5 positioned at the sheet feeding position inside the frame. Here, the sheet size inside the sheet storage means 19 is detected and the first drive transmission means disposed on the frame 10 and the second drive transmission means disposed on the sheet storage means 19 mate.

In FIG. 7, the female portion on the coupling 12 mates with the coupling pin 14. Through this, the drive force from the lift-up motor 11 can be transmitted as the elevating force for the sheet support stand 7 without any loss in power.

The drive force of the lift-up motor 11 as the drive means elevates the sheet support stand 7 by mating with the coupling 12 which is connected to the lift-up motor 11. The drive force is transmitted to the small and large gears 15 and 17 via the coupling pin on the sheet storage means 19 side and to the sheet support stand 7 via the belt 6.

The lever pushing portion 25 on the sheet trailing edge regulating guide 5 disposed on the sheet storage means 19 touches the size detection lever 22 on the detection means 20 disposed on the frame 10. Touched and rotated the size detection lever 22 detects the size of the sheet with the size detection sensor 21.

When the sheet storage means 19 is pushed in, and positioned at the sheet feeding position, the sheet size detecting means 20 is arranged at a position overlapping at least one of the first drive transmission means and the second drive transmission means, looking from the sheet stacking direction.

The following shall describe the sheet size detecting means according to the present invention.

FIGS. 8A–8F are views showing the size detection lever 22 that detects each type of sheet size stored in the sheet storage means 19 in the sheet feeding means according to the present invention.

FIGS. 8A–8F are views showing the sheet storage means 19 when it is positioned at the sheet feeding position, and when the lever pushing portion 25 on the sheet trailing edge regulating guide 5 on the sheet storage means 19 is touching the detection lever touching portion 23 on the detection means 20 size detection lever 22 on the sheet storage means 19. The detection means 20 is disposed on one side thereof with the three size detection levers of 22*a*, 22*b* and 22*c*. It is configured so that their rotations are detected by the size detection sensors 21*a*, 21*b* and 21*c*.

To each of the detection levers of 22*a*, 22*b* and 22*c* are formed the detection touching portions 23*a*, 23*b* and 23*c* in three locations at determined positions. The numbers 23*a*, 23*b* and 23*c* on the detection lever touching portion 23 all have the same functions and configuration, and the same numbers applied to the detection lever touching portion 23 are applied for each of the detection levers of 22*a*, 22*b* and 22*c*.

The size detection of each sheet size is ascertained by the lever pushing portion 25 on the sheet trailing edge regulating guide 5 on the sheet storage means touching and rotating either of the detection lever touching portions of 23*a*, 23*b* and 23*c* on the size detection lever 22 in the detection means 20 and the size detection sensor 21 detecting the size detection lever 22.

Six types of sheet sizes are detected, shown in FIG. 8 of the preferred embodiment of the present invention.

Figure 8A:
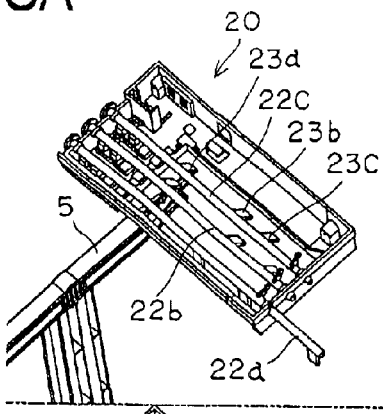
FIGS. 8A–8F show the detection of each type of sheet size stored in the sheet storage means in the sheet feeding means according to the present invention.

FIG. 8A shows a small size sheet, such as an A5 size sheet stored in the sheet storage means 19. The lever pushing portion 25 on the sheet trailing edge regulating guide 5 touches the touching portion 23*c* on the size detection lever 22*b* and the touching portion 23*a* on the size detection lever 22*c* to rotate the size detection lever 22*b* and the size detection lever 22*c*.

The size detection sensor 21 detects the size detection levers 22*b* and 22*c* to be ON and 22*a* to be OFF. Specifically, the detection sensor detects that they are OFF, ON and ON. The OFF, ON and ON combination detects A5 because that is what is prescribed.

Figure 8B:
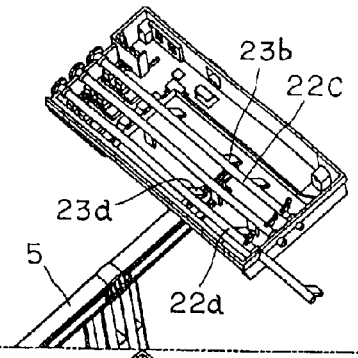

FIG. 8B shows a B5 size sheet stored in the sheet storage means 19. The lever pushing portion 25 on the sheet trailing edge regulating guide 5 touches the touching portion 23*a* on the size detection lever 22*a* and the touching portion 23*b* on the size detection lever 22*b* to rotate the size detection lever 22*a* and the size detection lever 22*c*.

The size detection sensor 21 detects the size detection levers 22*a* and 22*c* to be ON and 22*b* to be OFF. Specifically, the detection sensor detects that they are ON, OFF and ON. The ON, OFF and ON combination detects B5 because that is what is prescribed.

Figure 8C:
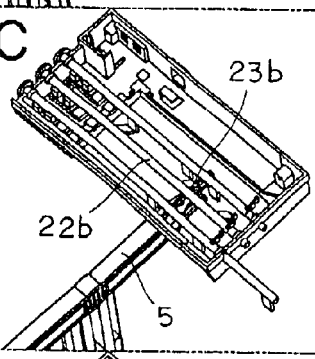

FIG. 8C shows a A4 size sheet stored in the sheet storage means 19. the lever pushing portion 25 on the sheet trailing edge regulating guide 5 touches the touching portion 23*b* on the size detection lever 22*b*. The size detection lever 22*b* is rotated.

The size detection sensor 21 detects the size detection lever 22*b* to be ON and size detection levers 22*a* and 22*c* to be OFF. Specifically, the detection sensor detects that they are OFF, ON and OFF. The OFF, ON and OFF combination detects A4 because that is what is prescribed.

Figure 8D:
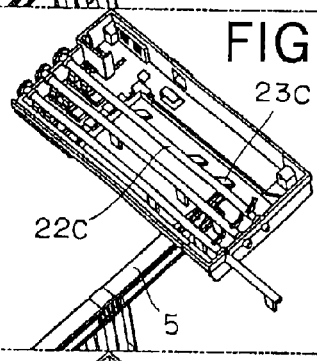

FIG. 8D shows a LT size sheet stored in the sheet storage means 19. The lever pushing portion 25 on the sheet trailing edge regulating guide 5 touches the touching portion 23*c* on the size detection lever 22*c*. The size detection lever 22*c* is rotated.

The size detection sensor 21 detects the size detection lever 22*c* to be ON and size detection levers 22*a* and 22*b* to be OFF. Specifically, the detection sensor detects that they are OFF, OFF and ON. The OFF, OFF and ON combination detects LT because that is what is prescribed.

Figure 8E:
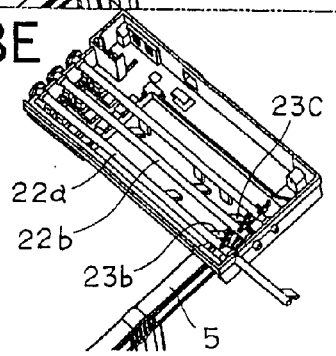

FIG. 8E shows a B4 size sheet stored in the sheet storage means 19. The lever pushing portion 25 on the sheet trailing edge regulating guide 5 touches the touching portion 23*a* on the size detection lever 22*a* and the touching portion 23*c* on the size detection lever 22*b* to rotate the size detection lever 22*a* and the size detection lever 22*b*.

The size detection sensor 21 detects the size detection levers 22*a* and 22*b* to be ON and 22*c* to be OFF. Specifically, the detection sensor detects that they are ON, ON and OFF. The ON, ON and OFF combination detects B4 because that is what is prescribed.

Figure 8F:
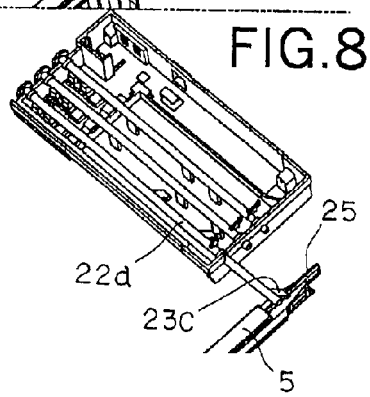

FIG. 8F shows a A3 size sheet stored in the sheet storage means 19. The lever pushing portion 25 on the sheet trailing edge regulating guide 5 touches the touching portion 23*c* on the size detection lever 22*a*. The size detection lever 22*a* is rotated.

The size detection sensor 21 detects the size detection lever 22*a* to be ON and size detection levers 22*b* and 22*c* to be OFF. Specifically, the detection sensor detects that they are ON, OFF and OFF. The ON, OFF and OFF combination detects A3 because that is what is prescribed.

As described in detail above, in the sheet feeding apparatus according to the present invention, in cooperative action with the sheet regulating means for regulating one edge of the sheets at the position corresponding to the size of the sheet stored in the sheet storage means, the sheet size detecting means for detecting the size of the sheets stored in the aforementioned sheet storage means is configured to be arranged in a position overlapping the aforementioned sheet storage means looking from the sheet stacking direction when the aforementioned sheet storage means has entered the aforementioned moving path in the aforementioned frame and is at the sheet feeding position, thereby allowing the sheet size detecting means not to protrude outside of the sheet feeding apparatus and enabling a more compact apparatus.

Also, in the sheet feeding apparatus according to the present invention, the position of the sheet detection means accurately and in a stable manner detects the sizes of sheets stored without being affected by the status of the joining of the sheet feeding apparatus and the image forming apparatus and without it being necessary to precisely position the image forming apparatus and the sheet feeding apparatus.

Figure 9:
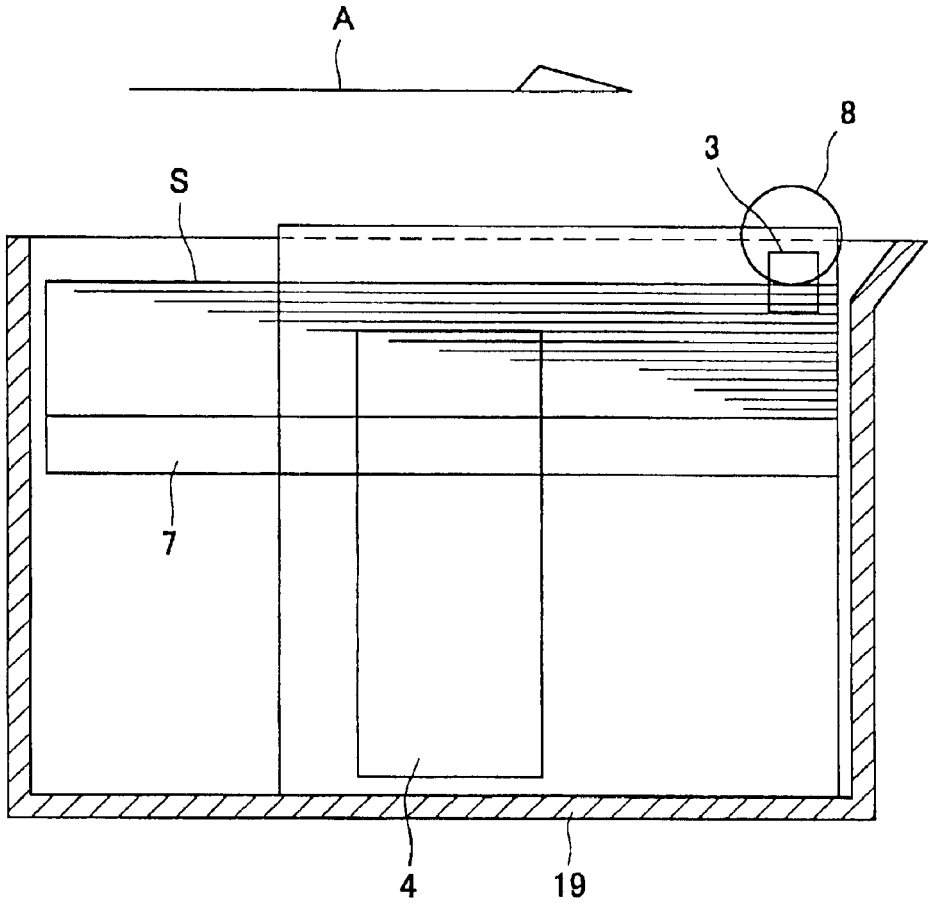
FIG. 9 shows the first embodiment of the invention and shows an example of the arrangement in the sheet storage means of the regulating means composed of the first regulating means and the second regulating means.

FIG. 9 shows an example of the arrangement in the sheet storage means 19 of the sheet regulating means composed of the first regulating means 3 and the second regulating means 4.

In the sheet storage means 19 are formed on the sheet path direction 1 edge side near the sheet feeding means pick-up rollers 8 are the pressure regulating rollers 3 that are the first regulating means for regulating the stacked sheet S.

Also, to substantially the central position of one edge side of the sheet storage means 19 is formed the pressure regulating plate 4 which is the second regulating means. The pressure regulating plate 4 is formed comprising a determined width with a length from the bottom to the top in the sheet stacking direction along the wall on one side on the inside of the sheet storage means. The arrow A indicates the sheet feeding direction.

The pressure regulating rollers 3 which is the first regulating means near the sheet feeding means regulates the edge of the sheets at a position near the sheet feeding means. The sheet S fed by the sheet feeding means is regulated on a side by the pressure regulating rollers 3 in the first regulating means 1 from the feeding means to the just before it is separated enabling the sheet S to be fed securely and in the appropriate posture.

Furthermore, the pushing pressure by the first regulating means is weaker than the pushing pressure by the second regulating means and by be substantially 0, there is no load on the sheet so it is possible to separate sheets into single sheets and to feed them in the appropriate feeding direction.

Still further, the configuration can set the pushing pressure of the urging means so that the pushing pressure of the second regulating means in the sheet stacking direction in the sheet storage means, is weaker on the uppermost sheet than the pushing pressure of the first regulating means toward the lower sheets.

Figure 10A:
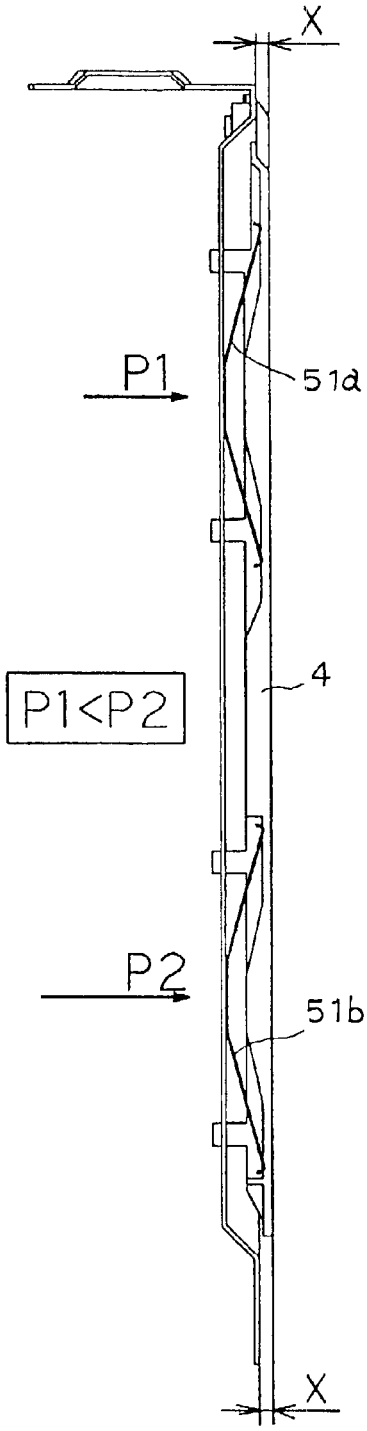
FIGS. 10A–10B are a drawing of the second embodiment of the invention showing leaf springs that apply pressure to the pressure regulating plate, established at both the upper and lower portions of the pressure regulating plate.
Figure 10B:
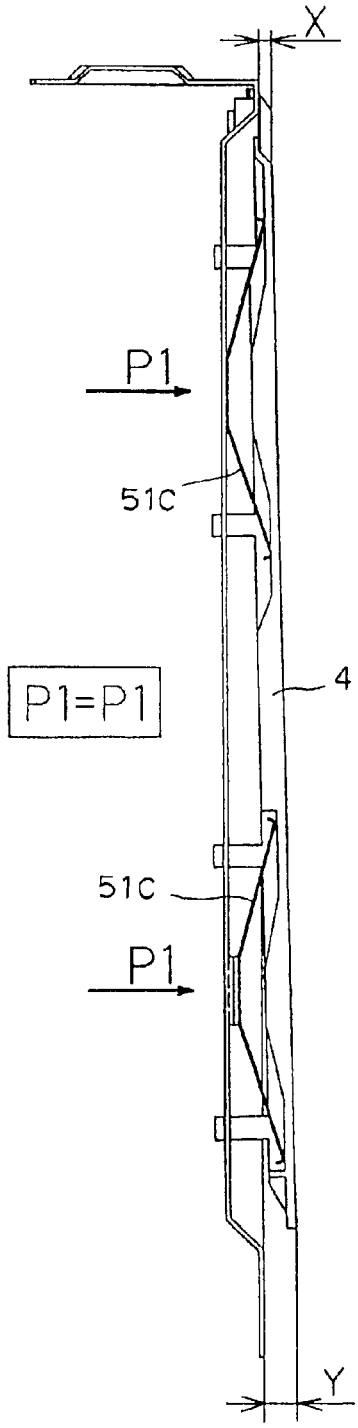

FIGS. 10A, 10B are views showing the leaf spring 51 that applies pressure to the pressure regulating plate 4 disposed on the top and bottom of the pressure regulating plate 4.

The leaf spring 51 urges the pressure regulating plate 4 and the pushing pressure P1 and P2 is applied to the pressure regulating plate 4 via the leaf spring 51.

FIG. 10A shows the configuration of the leaf spring 51*a* arranged on the top to have a weaker rebounding force than the leaf spring 51*b* disposed on the bottom, in the sheet stacking direction of the sheet storage means. The leaf spring 51*b* which is arranged below uses a rebounding force that is stronger than that for the leaf spring 51*a* which is arranged above. The gap X between the leaf springs 51*a* and 51*b* and the pressure regulating plate 4 is the gap X which is the same above and below. The pushing pressure P1 and P2 which urges the pressure regulating plate 4 are set so that the pushing pressure P1 is weaker toward the uppermost sheet than the pushing pressure P2 toward the lower sheet.

FIG. 10B shows the configuration of the leaf spring 51*c* arranged on the top and the leaf spring 51*c* arranged on the bottom to have equivalent rebounding force, in the sheet stacking direction of the pressure regulating plate 4. The gap between the leaf spring 51*c* and the pressure regulating plate 4 is configured so that the lower gap Y is larger than the upper gap X. (The relationship is set to X<Y.) The bottom of the pressure regulating plate 4 is angled toward the sheet stacking side.

Therefore, as sheets are stacked, if the gaps X and Y between each leaf spring 51*c* and the pressure regulating plate 4 are the same, the amount that the upper and lower leaf springs 51*c* retract differs, so in the end the leaf spring 51*c* retracted further to the bottom side has a higher pushing pressure on the pressure regulating plate 4 toward the sheet.

This enables the pressure regulating plate 4 to push the sheet with a pushing force that differs at upper and lower positions in the sheet stacking direction in the sheet storage means 19. Also, at a position near the pick-up rollers 8, the pressure that the pressure regulating plate 4 pushes on the sheet is lowered so that no more pushing pressure than is required is applied to the sheet to enable it to be separated into single sheets and then fed.

At a position lower and separated from the position near the pick-up rollers 8, the pushing pressure on the pressure regulating plate 4 that pushes the sheet is large to securely align the sheets, regardless of the difficulty to align the sheets because the are overlapping each other in the sheet storage means.

Figure 11:
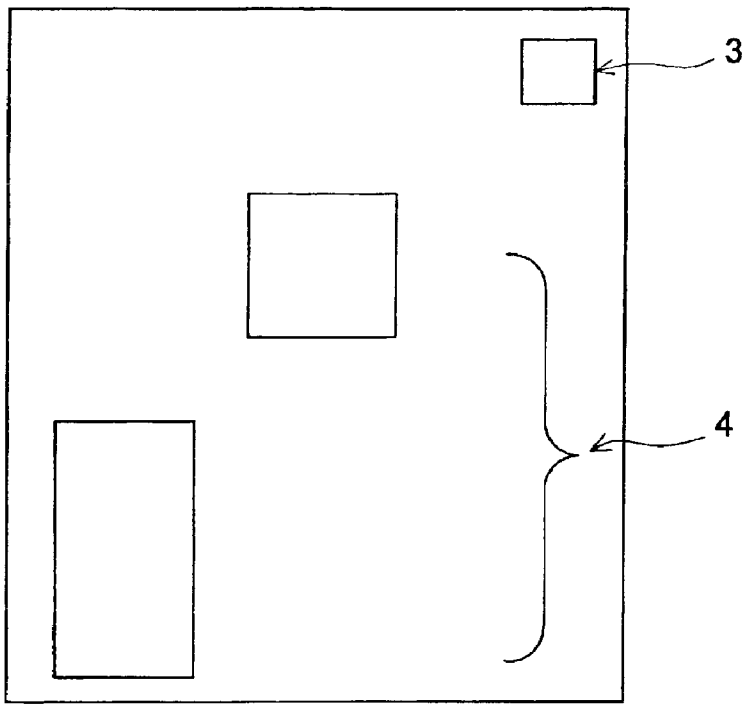
FIG. 11 shows an example of the second regulating means composed of two regulating means in the regulating means composed of the first regulating means and the second regulating means.

FIG. 11 shows an example of the second regulating means composed of two regulating means in the regulating means composed of the first regulating means and the second regulating means.

The two regulating means of the first regulating means 3 and the second regulating means 4 are configured to have different pushing pressures. First, the pushing pressure of the first regulating means 3 above in the sheet stacking direction is low, and the pushing pressure of the regulating means positioned at the top for the second regulating means 4 is greater than that of the first regulating means 3. Also, the pushing pressure of the regulating means positioned below for the second regulating means 4 is larger still than the regulating means positioned above.

The arrangement configuration of the first and the second regulating means allows the lower regulating means pushing pressure to be gradually released by the upper regulating means to prevent bending of the sheets and mis-pick-ups.

Figure 12:
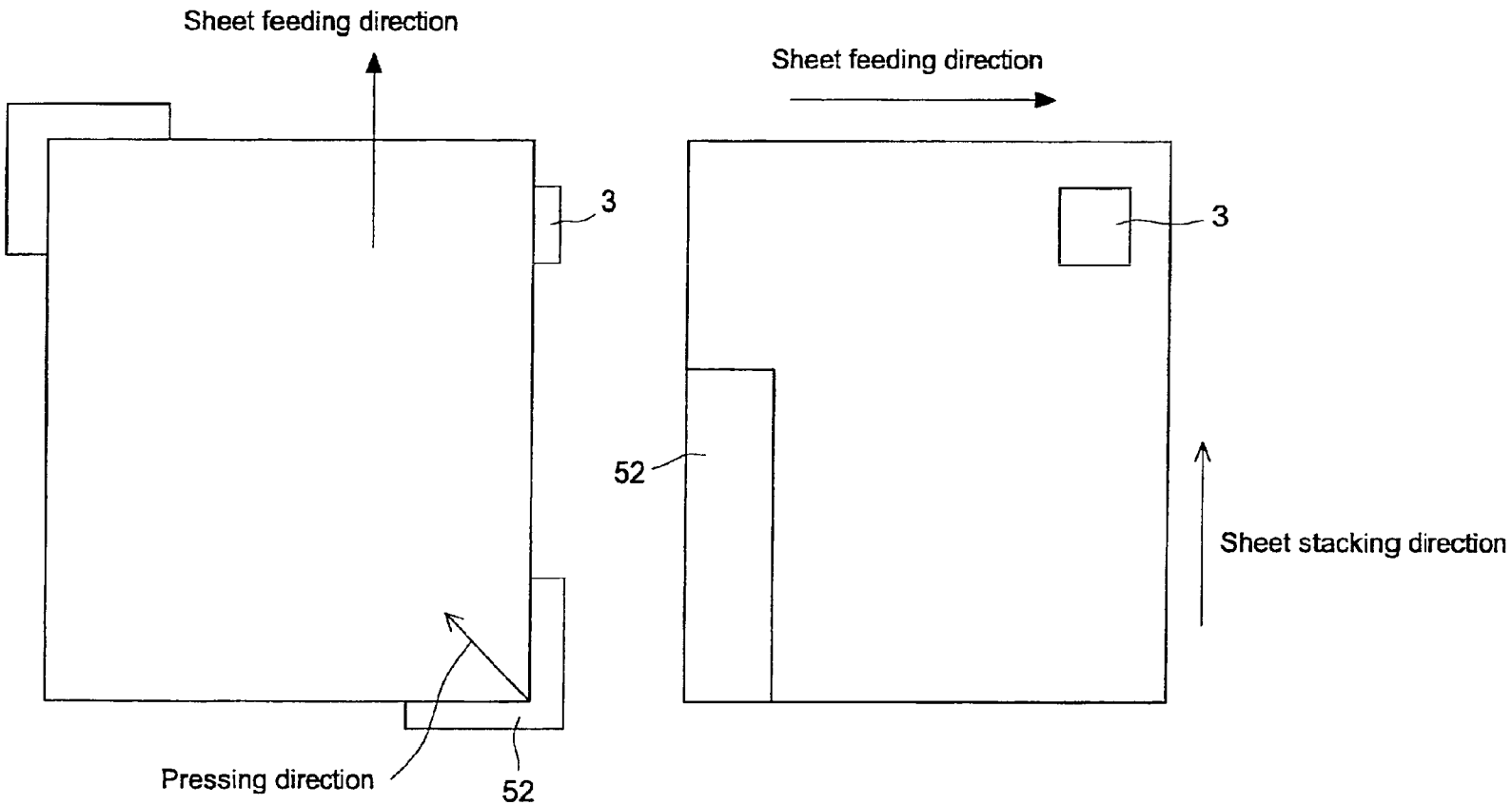
FIG. 12 shows an example configuration of pressing on two edges of a sheet using one regulating means.

FIG. 12 shows an example configuration of pressing on two edges of a sheet using one regulating means. In the sheet storage means 19, the second regulating means 52 is formed into an L shape to regulate two edges of the sheets at the other corner of the first regulating means 3. This allows one second regulating means 52 to regulate two sides of the sheet S. The pushing pressure of the second regulating means 52 acts toward the opposing corner. This enables one regulating means 52 strong alignment force in this embodiment.

Note that the pushing pressure applied to the sheet that differing for the first regulating means 3 and the second regulating means 52 and the first regulating means itself differing in the sheet stacking direction are the same as the examples of FIG. 9 and FIG. 11.

What we claim is:

1. A sheet feeding apparatus comprising:

sheet storage means for storing sheets, support means for supporting the sheet storage means so that the sheet storage means can move in a moving path between a sheet replenishing position and a sheet feeding position, frame means for fastening the support means, sheet feeding means for separating the sheets stored in the sheet storage means into a single sheet and feeding the single sheet to the sheet feeding position, and sheet size detecting means for detecting a size of the sheets stored in the sheet storage means, said sheet size detecting means disposed in the moving path in the frame means.

2. A sheet feeding apparatus according to claim 1, wherein said sheet size detecting means is arranged in a position overlapping the sheet storage means in a sheet stacking direction when the sheet storage means is positioned at the sheet feeding position.

3. A sheet feeding apparatus according to claim 2, further comprising a regulating means for regulating edges of the sheets stored in the sheet storage means at a position corresponding to the size of the sheets, said sheet size detecting means detecting the regulating means when the sheet storage means is positioned at the sheet feeding position.

4. A sheet feeding apparatus according to claim 1, further comprising a regulating means for regulating edges of the sheets stored in the sheet storage means at a position corresponding to the size of the sheets, said sheet size detecting means detecting the regulating means when the sheet storage means is positioned at the sheet feeding position.

5. A sheet feeding apparatus according to claim 4, wherein said sheet size detecting means has size detecting levers that are actuated when a lever pushing portion of the sheet regulating means abuts against the size detecting levers, said size detecting levers configured to detect the size of the sheets stored in the sheet storage means according to which of the detection levers is actuated.

6. A sheet feeding apparatus comprising:

sheet storage means comprising a sheet support stand that can move up and down, drive means for driving the sheet support stand to move up and down, drive transmission means for transmitting a driving force from the drive means to the sheet storage means, support means for supporting the sheet storage means so that the sheet storage means can move in a moving path between a sheet replenishing position and a sheet feeding position, frame means for fastening the support means, sheet feeding means for separating the sheets in the sheet storage means into a single sheet and feeding the single sheet to the sheet feeding position, and sheet size detecting means for detecting a size of the sheets stored in the sheet storage means, said sheet size detecting means arranged in a position overlapping the drive transmission means in a sheet stacking direction when the sheet storage means is positioned at the sheet feeding position.

7. A sheet feeding apparatus according to claim 6, further comprising a regulating means for regulating edges of the sheets stored in the sheet storage means at a position corresponding to the size of the sheets, said sheet size detecting means detecting the regulating means when the sheet storage means is positioned at the sheet feeding position.

8. A sheet feeding apparatus according to claim 7, wherein said sheet size detecting means has size detecting levers that are actuated when a lever pushing portion of the sheet regulating means abuts against the size detecting levers, said size detecting levers configured to detect the size of the sheets stored in the sheet storage means according to which of the detection levers is actuated.

9. A sheet feeding apparatus according to claim 6, wherein said drive transmission means is composed of a first drive transmission means established on the frame means and a second drive transmission means established on the sheet storage means, said second transmission means arranged to be able to connect to and separate from the first drive transmission means.

10. A sheet feeding apparatus according to claim 9, wherein said first drive transmission means and said second drive transmission means are connected when the sheet storage means is positioned at the sheet feeding position, and said first drive transmission means and said second drive transmission means are separated when the sheet storage means is positioned at the sheet replenishing position.

11. A sheet feeding apparatus according to claim 10, further comprising a regulating means for regulating edges of the sheets stored in said sheet storage means at a position corresponding to the size of the sheets, said sheet size detecting means detecting the regulating means when the sheet storage means is positioned at the sheet feeding position.

12. A sheet feeding apparatus according to claim 11, wherein said sheet size detecting means has size detecting levers that are actuated when a lever pushing portion of the sheet regulating means abuts against the size detecting levers, said size detecting levers configured to detect the size of the sheets stored in the sheet storage means according to which of the detection levers is actuated.

13. A sheet feeding apparatus according to claim 9, further comprising a regulating means for regulating edges of the sheets stored in said sheet storage means at a position corresponding to the size of the sheets, said sheet size detecting means detecting the regulating means when the sheet storage means is positioned at the sheet feeding position.

14. A sheet feeding apparatus according to claim 13, wherein said sheet size detecting means has size detecting levers that are actuated when a lever pushing portion of the sheet regulating means abuts against the size detecting levers, said size detecting levers configured to detect the size of the sheets stored in the sheet storage means according to which of the detection levers is actuated.

15. A sheet feeding apparatus comprising:

sheet storage means for storing sheets, support means for supporting the sheet storage means so that the sheet storage means can move in a moving path between a sheet replenishing position and a sheet feeding position, frame means for fastening the support means, sheet feeding means for separating the sheets stored in the sheet storage means into a single sheet and feeding the single sheet to the sheet feeding position, and sheet size detecting means for detecting a size of the sheets stored in the sheet storage means, said sheet size detecting means established in a position overlapping the moving path in a sheet stacking direction.

16. An image forming apparatus comprising:

a sheet storage means having a sheet support stand that can move up and down; drive means for driving the sheet support stand to move up and down; drive transmission means for transmitting a driving force from the drive means to the sheet storage means; support means for supporting the sheet storage means so that the sheet storage means can move in a moving path between a sheet replenishing position and a sheet feeding position; frame means for fastening the support means; sheet feeding means for separating sheets stored in the sheet storage into a single sheet and feeding the single sheet to the sheet feeding position; sheet size detecting means for detecting a size of the sheets stored in the sheet storage means, said sheet size detecting means arranged in a position overlapping the drive transmission means in a sheet stacking direction when the sheet storage means is positioned at the sheet feeding position.

* * * * *